166-250 SR
FIP8011 XR 4,049,056

United States Patent [19]

Godfrey

[11] 4,049,056

[45] Sept. 20, 1977

[54] OIL AND GAS WELL STIMULATION

[75] Inventor: Charles S. Godfrey, Berkeley, Calif.

[73] Assignee: Physics International Company, San Leandro, Calif.

[21] Appl. No.: 700,470

[22] Filed: June 28, 1976

Related U.S. Application Data

[63] Continuation-in-part of Ser. No. 250,184, May 4, 1972, abandoned, which is a continuation-in-part of Ser. No. 138,618, April 29, 1971, abandoned.

[51] Int. Cl.[2] ..... E21B 43/26

[52] U.S. Cl. ..... 166/299; 166/63; 166/177; 166/250; 166/308

[58] Field of Search ..... 166/299, 250, 259, 271, 166/308, 63, 177; 239/177

[56] References Cited

U.S. PATENT DOCUMENTS

| | | | |
|---|---|---|---|
| 2,272,477 | 2/1942 | Pfleger | 417/73 |
| 2,740,478 | 4/1956 | Greene | 166/63 |
| 2,766,828 | 10/1956 | Rachford, Jr. | 166/299 |
| 2,988,143 | 6/1961 | Scotty | 166/299 |
| 3,170,517 | 2/1965 | Graham et al. | 166/308 X |
| 3,422,760 | 1/1969 | Mohaupt | 166/63 X |
| 3,589,604 | 6/1971 | Paul | 239/177 X |
| 3,616,857 | 11/1971 | Camberley et al. | 166/299 |
| 3,674,093 | 7/1972 | Reese | 166/299 |
| 3,702,635 | 11/1972 | Farr | 166/299 |
| 3,744,579 | 7/1973 | Godfrey | 166/63 X |

*Primary Examiner*—Stephen J. Novosad
*Assistant Examiner*—George A. Suchfield
*Attorney, Agent, or Firm*—Lindenberg, Freilich, Wasserman, Rosen & Fernandez

[57] ABSTRACT

A method for stimulating oil and gas wells to increase production including filling the lower portion of the well above the pay zone level having exposed rock with a fracturing fluid, and sealing the well above the lower portion. A shock wave is then applied to the fracturing fluid, which, when applied thereby to the rock at the pay zone creates a stress wave in the rock having a rise time faster than the time required for sound to traverse one half the periphery of the rock at the pay zone, and having an amplitude which will fracture but not crush the rock.

17 Claims, 11 Drawing Figures

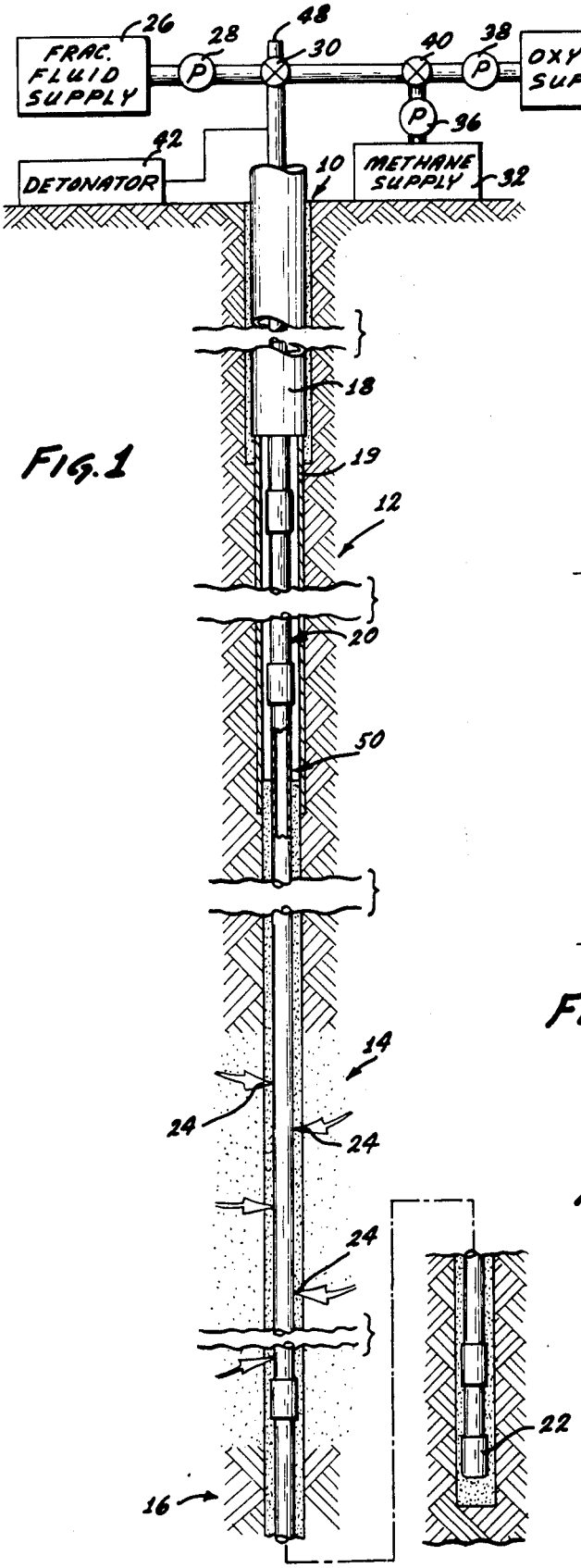
FIG. 1
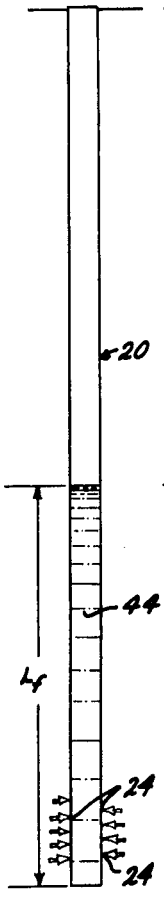
FIG. 2
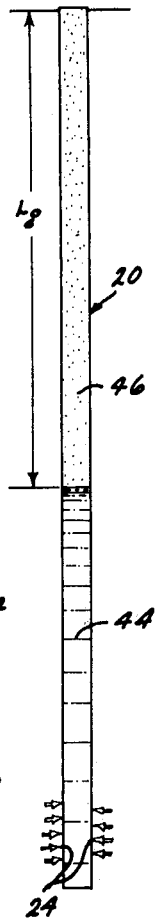
FIG. 3
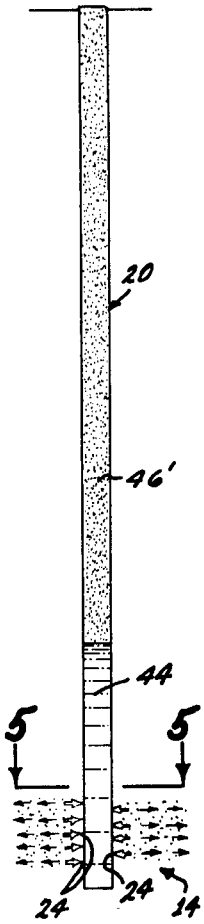
FIG. 4
FIG. 5
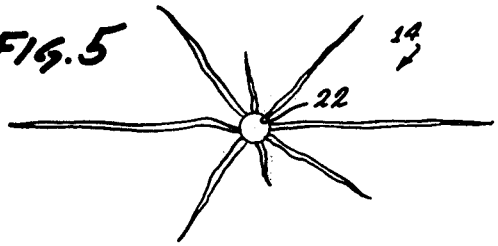

OIL AND GAS WELL STIMULATION

CROSS-REFERENCES TO RELATED APPLICATION

This application is a continuation-in-part of application Ser. No. 250,184 filed May 4, 1972 now abandoned, which is a continuation-in-part of application Ser. No. 138,618, filed Apr. 29, 1971, now abandoned.

BACKGROUND OF THE INVENTION

1. Field of the Invention

This invention relates to methods and apparatus for stimulating wells by the injection of fluid therein.

2. Description of the Prior Art

Hydrocarbon wells can be stimulated to increase the flow rate of gas or oil by forming fractures in the pay zone where the oil and gas is located. If numerous long fractures can be formed that radiate in all directions from the well bore, then oil or gas can flow into the fractures and to the well bore. One method which has been used for oil well stimulation is the detonation of an explosive charge in the well. However, this tends to crush a limited region near the well bore rather than to open extended fractures out into the producing zone. Furthermore, the pressure impulse from such an explosion generally cannot be maintained for more than a few milliseconds. Since the maximum velocity of crack propagation in typical rocks is on the order of 5000 feet per second, a crack generally cannot propagate more than a few feet when driven by reasonable amounts of high explosive. Because of the fact that detonation used heretofore caused rock crushing rather than cracks, propellants or slow burning explosives are used for the specified purpose. These are normally enclosed in a container which is placed underneath the fracturing fluid surface where they are ignited. However, because of the slow rise time of the impulse caused by the deflagration of the propellant, not many cracks occur (normally one or two) and the fluid pressure is quickly drained off or reduced by the crack which can propagate the easiest, preventing further crack formation and propagation.

Another method which has been used for well stimulation is hydraulic fracturing, which involves the pumping of a fracturing fluid down through the well using large powerful pumps at the surface of the earth. The pressure of the fluid can create fractures, while sand or other propping agents in the fracturing fluid can hold them open after pumping is stopped. Hydraulic fracturing often is successful in stimulating oil and gas well production, but the amount of stimulation is often limited and the cost is high.

In a typical hydraulic fracturing operation, a group of pumping rigs are parked near the well and used to pump fracturing fluid down the well bore at what might ordinarily be considered a high pressure and volume rate. For example, the group of rigs might pump at a flow rate of thousands of gallons of fluid per minute and at pressures at the top of the well of thousands of pounds per square inch, for a period such as a half hour, until perhaps a hundred thousand gallons have been pumped in. This fluid flow is intended to pass out of the well bore at the pay zone, and thus to create long fractures. In some cases, a propellant charge, such as a canister filled with a solid propellant, is lowered into the well and ignited at the level of the pay zone soon after surface pumping begins. The propellant burns in a period such as several miliseconds to create a very high pressure pulse to help start the fractures. Fluid pumped from the surface can thereafter pass along the fractures to elongate them.

While conventional hydraulic fracturing equipment can create fractures which can improve production, its effectiveness is limited by the pressure and volume of fluid it can deliver at the bottom of the well for injection into the pay stratum. Part of the limitation is due to the limited capacity of even very expensive pumping rigs to supply fluid at very high pressure and volumes. The pressure and volume are also limited by reason of the resistance to very rapid flow of fluid through perhaps thousands of feet of pipe that is only several inches in diameter, between the surface pumps and the production zone.

The limitation of pressure and volume is significant because producing formations are generally weaker in one direction than in other directions. Thus, cracks tend to propagate along only the weakest direction. Furthermore, because of stress concentrations at the tip of a fracture, it takes less pressure to propagate a fracture than to initiate one. Once a fracture has formed, therefore, it is difficult to build up pressure sufficient to create additional fractures, since the fluid tends to flow into and propagate the initial fractures.

If a limited pressure and flow rate of fracturing fluid is supplied as by pumping or propellant actuated fluids there is a tendency to create only two fractures that radiate in opposite directions from the well bore along the weakest direction of the formation. These fractures drain off the fracturing fluid, so that pressure cannot build up to create and extend fractures in other directions that are not quite as weak. If a high pressure and flow rate of fracturing fluid could be supplied at the pay zone level of the well bore, then the fractures which initially open along the weakest direction could not drain off fluid fast enough to lower the pressure to a level below that required for fracture initiation. The pressure would then be high enough to open and extend fractures in other directions.

Conventional hydraulic fracturing is limited also by the high cost of the equipment and labor. Each pumping rig may cost several hundred thousand dollars, so that a group of ten that might be used during an operation may cost several million dollars. The cost of renting and operating such rigs can limit their use. A method for fracturing that utilized equipment which had a minimum capital cost and which could be operated with moderate manpower would find wider utilization, particularly if it could produce superior fracturing.

Rock fracturing occurs in response to a stress wave having a sufficiently high amplitude but which is still below the amplitude which causes rock crushing. However, if the rise time of the stress wave is not sufficiently rapid, the first crack will relieve the stress. Stress waves having a sufficiently rapid rise time are caused by detonating explosives as opposed to deflagrating explosives or propellants. The trouble is however that detonating explosives of the type which are usually used create a rock crushing force rather than a rock fracturing force. Reducing the amount of explosives to avoid crushing rock and still cause fractures reduces the duration of the stress wave so that it is too short to be effective, since the interval of the application of the stress wave is also important. Also the technique of denotation should be one which provides sufficient pumping horsepower at the bottom of the well bore to maintain a high fluid injection pressure in spite of the loss of fluid into the first cracks to be created in order to extend the cracks which are created by the stress wave.

OBJECTS AND SUMMARY OF THE INVENTION

An object of this invention is to provide a method and means for detonating an explosive in a well which provides a stress wave which can create multiple rock fractures without rock crushing and which can inject fracturing fluid at sufficient high pressure and flow rate to extend the fractures created.

Another object is to provide a novel method and means for quickly and repeatably injecting a quantity of fracturing fluid at a very high pressure and flow rate into the pay zone formation of a hydrocarbon well, and for repeating such injections at short intervals.

Another object of the present invention is to provide a method and means for stimulating oil and gas wells, which is economical and highly effective.

In accordance with one embodiment of the present invention a hydrocarbon well stimulation method is provided for injecting fracturing fluid at a high pressure and flow rate into a marginally productive formation surrounding a well bore. The method includes filling the lower portion of a high strength casing or tubing in the well that extends up from the pay zone, with fracturing fluid, filling the portion above it with a detonatable gas mixture, and sealing the upper end of the casing or tubing. The gas is then detonated to initially create a rapid rise time shock wave which is applied to the column of fracturing fluid immediately below it. The casing or tubing is perforated or otherwise open at the pay zone to enable fluid to be injected therein. The rapid rise time shock wave causes a rapid rise time stress wave in the rock strata thereby creating fractures radiating in many directions from the well bore. The denoted gas also creates a high pressure gas reservoir that can pump the column of fluid below it causing it likewise to have a high pressure thus causing the fractures which have been created to be extended. After perphaps several seconds, when most of the fluid has been injected, the gaseous products of the ignition are exhausted. Then more fracturing fluid and ignitable gases are pumped into the well to repeat the injection cycle so as to elongate the fractures which have been started.

The columns of fracturing fluid and of ignitable gas are each over a hundred feet in length. The high pressure of the gas, after detonation, enables it to pump with a power that may be tens or hundreds of times as great as that which can be supplied by a bank of high performance pumping rigs of the type currently available. The attainment of a high pressure and flow rate for the fracturing fluid is enhanced by the fact that the pumping power supplied by the gas after detonation is applied deep within the well. The shorter distance to the fluid injection level results in less power loss by reason of friction of the rapidly moving fluid with the walls of the well. Even though the volume of fluid which can be pumped at each cycle is limited, it is sufficient to open and appreciably extend numerous fractures. Succeeding cycles can readily extend the fractures to greater distances. The pressure and composition of the ignitable gases can be carefully selected so as to control the stress wave and the pressures created by detonation thereby assuring high fluid injection rates while minimizing the likelihood of damage to the equipment or crushing of the stratum. Not only can improved well stimulation be obtained, but the equipment and manpower which is required to relatively low.

In another embodiment of the invention the well is filled with a fracturing fluid above the pay zone. The well is then sealed at the level of the fluid. An explosive is suspended in the fluid in the region of the pay zone. The amount and type of explosive is determined so that when it is detonated the shock wave caused in the fluid applies a stress wave to the rock which has a rise time faster than the time required for sound to traverse one half the periphery of the rock at the pay zone, and with an amplitude which will fracture but not crush the rock. The explosive is then detonated.

The novel features of the invention are set forth with particularity in the appended claims. The invention will best be understood from the following description when read in conjunction with the accompanying drawings.

BRIEF DESCRIPTION OF THE DRAWINGS

FIG. 1 is a sectional view of well stimulation apparatus for performing well stimulation in accordance with the invention;

FIG. 2 is a simplified view of the well of FIG. 1, shown after the pumping of fracturing fluid therein;

FIG. 3 is a view similar to FIG. 2, shown after the pumping of ignitable gases into the well;

FIG. 4 is a view similar to FIG. 3, shown after the ignition of the ignitable gases and during the injection of fracturing fluid into the pay zone formation;

FIG. 5 is a view taken on the line 5—5 of FIG. 4, and indicating in a simplified manner, how fractures are created during the injection of fracturing fluid;

DESCRIPTION OF THE PREFERRED EMBODIMENTS

Figure 6:
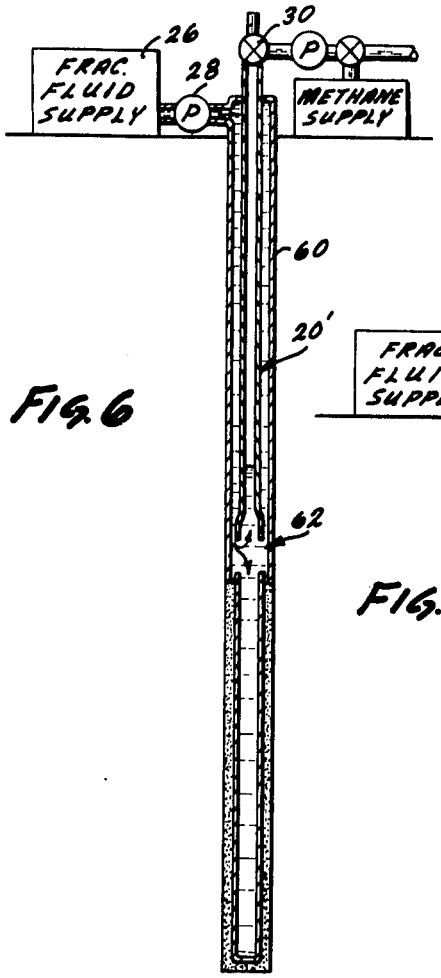
FIG. 6 is a sectional view of well stimulation apparatus constructed in accordance with another embodiment of the invention, shown during the pumping of fracturing fluid into the lower portion of the casing or tubing in the well.

FIG. 1 illustrates apparatus utilized to stimulate a well to increase the production of hydrocarbons such as oil. The well may have been recently drilled or may be an old well whose production has declined, and in either case the low production may be due to a relatively low permeability at the producing stratum or pay zone where the oil or gas is located. The well 10 is shown as extending through non-producing strata indicated at 12 and through the pay zone 14 into the stratum 16 below the pay zone. Increased production is obtained by creating cracks in the pay zone 14 that radiate for long distances in numerous directions from the well bore. Oil or gas in the pay zone, or producing formation can flow into these cracks and thence to the well bore to thereby greatly increase the production of the well. In accordance with the present invention, such cracks are created by filling the lower portion of the well above the pay zone with a fluid, filling the remaining portion of the well with a detonatable gas mixture, and detonating the gas mixture to create a rapid rise time shock wave together with a high pressure reservoir of gaseous combustion products that drive the fluid down the well so that it is injected into the pay stratum 14.

The shock wave rise time and duration is of the utmost importance since this is what sets up a rapid rise time stress wave in the rock formation which causes multiple radial fractures. Fractures occur in the rock strata at the weak regions spaced around the perimeter of the pay zone. These weak regions are not all equally weak. With a slow rise time stress wave such as produced by a propellant the first or at most the second fracture relieves the stress and pressure to the extent that no more fractures occur. With a fast rise time stress wave, the multiple radial fractures occur before the stress wave and pressure can be relieved. The duration for the compressive phase of the stress wave will be on the order of the time approximately determined by the circumference of the hole divided by the speed of sound through the rock strata. The rise time of the stress wave should be faster than at least one half the circumference of the hole divided by the speed of sound through the rock strata in order for this to occur. The amplitude of the stress wave produced by the detonation should also be less than the crushing strength of the rock, which may be on the order of 10,000 to 20,000 psi.

The well 10 is shown as including a large diameter casing 18 cemented into place along an uppermost well region, and an intermediate casing 19 extending along a region below the large casing. A long high pressure pipe 20 extends through the casing and down along the well to the bottom of the well. A lower portion of the pipe that extends through and below the pay zone 14 is also cemented in place. The cement grout is emplaced by the use of a cementing shoe 22. Perforations such as those indicated at 24 are formed in the high-pressure pipe 20 along the region that extends through the pay zone 14. Thus, the pipe forms a chamber that is gas-tight along the upper portion and open to the outflow of fluid at the lower portion. The perforations, which extend through the pipe, surrounding concrete, and into the surrounding strata, permit the inflow of oil to the well and also permit the injection of water into the formation during the stimulation process to be described. The high pressure pipe 20 may be already present in some wells, while in many other wells there is no high pressure casing or tubing. Where the high pressure piping must be installed, it is lowered and cemented in place, and the perforations 24 are formed by a string of explosive charges, all in a manner that is well known in the art.

In order to carry out the well stimulation process of the invention, apparatus is provided at the well head for pumping fracturing fluid into the well, for pumping a mixture of ignitable gases into the well, and for igniting the gases. This apparatus is shown in simplified view, as including a fracturing fluid supply 26, a liquid pump 28 for pumping the fracturing fluid, and a control valve 30 for admitting the fluid into the high pressure pipe 20 that extends down into the well. The detonatable gas supply includes a methane gas supply 32, an oxygen supply 34 (in many cases air is used as the oxygen supply, so that the oxygen supply consists of a tube open to the atmosphere), a pair of gas pumps 36, 38 for pressurizing the methane and oxygen, and a mixing valve 40. The outlet of the mixing valve is connected to the control valve 30 to direct the mixture of detonatable gases into the high pressure pipe 20 that extends down the well. A detonator 42 such as a spark or glow type is coupled to an upper end of the high pressure pipe 20 to detonate the gas mixture after the pipe has been filled.

FIG. 2 illustrates a first step of the stimulation process, which includes the pumping of fracturing fluid 44 from the supply 26 into the high pressure pipe 20 to fill a lower portion thereof having a length $L_f$. The fracturing fluid which can be referred to as a fracturing liquid, may include water or other liquid and may contain special propping agents such as sand or a variety of other ingredients that help to hold open the cracks. After the fracturing fluid has been pumped in, a mixture of detonatable gases 46 is pumped into the high pressure tube 20 to fill a length $L_g$ of the well. As shown in FIG. 3, the column of detonatable gas extends from the top of the column of fracturing fluid 44 to the top of the well. After the detonatable gases have been pumped in and the control valve 30 has been closed to seal the top of the pipe 20, the gases are detonated. The mixture of gases introduced into the well is determined as one which will detonate to provide a shock wave and thus stress wave rise time which is faster than the time required for sound to pass through one-half of the hole periphery in the rock strata which is being fractured and pressures which are less than the crushing strength of the said rock strata.

FIG. 4 illustrates the situation soon after the detonation of the gas. The detonation of the gas, besides the initial shock wave, creates a high pressure reservoir of gaseous combustion products in the upper portion of the pipe 20. This initial shock wave and high pressure acts against the column of fracturing fluid 44, and through the perforations 24 against the rock strata in the pay zone of the well. The rapid rise time stress wave created in the rock strata creates cracks in the pay zone formation 14, that tend to radiate in all directions. FIG. 5 is a simplified illustration taken at a section of the pay zone, illustrating such cracks or fractures. The fluid under high pressure can then enter and extend the fractures.

After a period of several seconds, when injection of the fracturing fluid into the pay zone formation has substantially ended, or all of the fluid has been injected, the control valve 30 is operated to permit the exhaust of the gaseous products into the atmosphere through an exhaust pipe 48. The process can then be repeated by again pumping in a column of fracturing fluid, pumping in a column of detonatable gas, and detonating the gas to inject the fracturing fluid into the pay zone. The repetition of the process allows additional fracturing fluid to be pumped into the fractures to extend them.

After sufficient repetitions of the process have occurred, the apparatus can be removed for use elsewhere. Where a high pressure pipe 20 has been installed only for the stimulation process, much of it can be removed. This can be accomplished by unscrewing or cutting the tubing at a depth 50 above the location where the pipe is cemented in the well bore and pulling it out. This removal of the high pressure tubing may be particularly desirable in the case of a deep well.

The length $L_f$ of a column of fracturing fluid generally should be at least several hundred feet long. The length of the column of ignitable gases $L_g$ also is generally at least several hundred feet long. The long length of the fracturing fluid column provides sufficient fluid to open many cracks in the formation and elongate them to an appreciable extent. The long length of the gas column provides a reservoir of high pressure gas after detonation, that can maintain a high pumping pressure during injection of the fracturing fluid into the pay zone. In many cases, the volumes of the gas and fracturing fluid columns are made approximately equal, so that if the high pressure tubing is of constant diameter the column lengths $L_f$ and $L_g$ are approximately equal. The lengths $L_f$ and $L_g$ of the columns are generally of the same order of magnitude, although they can be varied within wide limits. For example, a shorter length $L_g$ of the gas column may be provided if it is determined that the gas pressure will not drop excessively as the products of the ignition expand during fluid injection. Even in the case of a relatively shallow well, such as one only several hundred feet deep, the column of fracturing fluid and of detonatable gas will each be over a hundred feet in length.

The use of detonatable gases permits an accurate determination of the pressures which will be applied to the rock strata to avoid crushing while providing the proper rise time of the stress wave to insure multiple fractures. The gases can be diluted or pressurized in a manner well known in the art to achieve a desired result. The detonated gases apply a very high pumping power to the column of fracturing fluid. Once the gas is ignited, the ignition travels rapidly down the column at a rate on the order of nine feet per millisecond. Thus, it may require on the order of eleven milliseconds for the ignition of a gas column of a length of 100 feet. The column of gas may be pumped to a pressure such as 300 to 600 psi prior to ignition. After ignition, the pressure may increase by a factor of 15, for example, so that a pressure of 4500 to 9000 psi may be obtained for injecting the fluid into the pay formation. Tubing is available that can withstand such pressures over many injection cycles.

The use of a long column of fluid and the application of pressure by the explosive downward upon the fluid surface rather than in the region adjacent the pay zone underneath the surface of the fluid, as is the present practice, insures that there is enough fluid for the fracturing operation and also that there is no wasted energy. When an explosive is used underneath the fluid surface adjacent the pay zone, it not only applies pressure to the rock surface adjacent the pay zone but applies pressure to drive the fluid upward against the force of gravity, which comprises wasted energy.

The power which can be applied by the column of gas to the fluid after detonation may be on the order of one hundred times the power that can be applied by a bank of high pressure pumps of the type currently available. Furthermore, the pressure is applied to the surface of the column of the fracturing fluid which is located deep within the well, and which moves down as the fracturing fluid is injected and the fluid level decreases. The application of high pressure closer to the level where fluid is injected into the formation reduces pressure losses normally resulting from the long distance that fluid must travel between the surface of the earth and the level of the pay zone. Pressure losses are further reduced because the fluid flow takes place in large diameter tubing whereas common practice in conventional hydraulic fracturing is to use small diameter tubing for high pressure flow. Thus, there is a higher pressure available at the injection level, as compared to the case of hydraulic pumps that apply pressure at the top of the well bore. There is a reflection of the shock wave that first strikes the surface of the fluid, then is reflected to the top of the well and then down again. This occurs for several cycles and adds to the pumping action of the system.

The high pressure of fluid at the injection level, maintained during a high flow rate, encourages the elongation of fractures in numerous directions. In addition, the high pressure can tend to elongate the cracks away from the well bore, rather than parallel to the bore where the cracks could enter non-bearing strata above or below the pay stratum.

The well stimulation of this invention can be carried out in relative safety. The detonatable gases are mixed at the well head, and all personnel can be stationed away from the well head during such mixture and until after detonation and later exhaustion of the gas products of combustion. The use of gases makes the process relatively economical, because detonatable gases such as a stoichiometric mixture of methane and oxygen are often available at low cost at the well head. Propane or Butane may be used in place of methane, and are illustrative of other gases which can be used. Methane and oxygen in a stoichiometric mixture cause a detonation pressure when detonated on the order of thirty times the initial pressure. Thus, if the pressure of the gases before detonation is 200 psi, the detonation pressure will be 6,000 psi.

The recycling of the stimulation process can be accomplished in a period of several minutes. The recycling time is largely limited by the time it requires to pump in the fracturing fluid, inasmuch as the pumping in of detonatable gases, the period of fluid injection after detonation, and the exhaust of gases can be accomplished rapidly.

Figure 7:
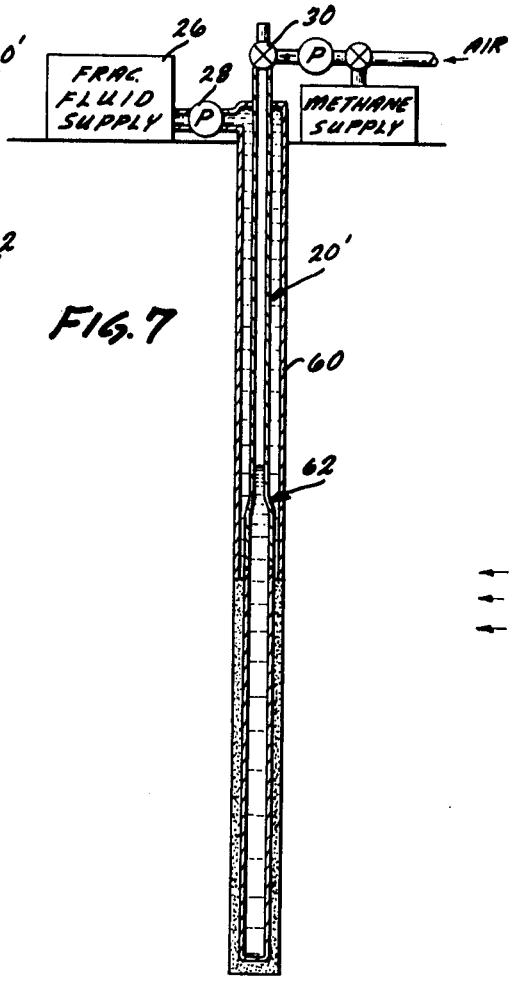
FIG. 7 is a view similar to FIG. 6, but showing the apparatus during the pumping of ignitable gases therein.
Figure 8:
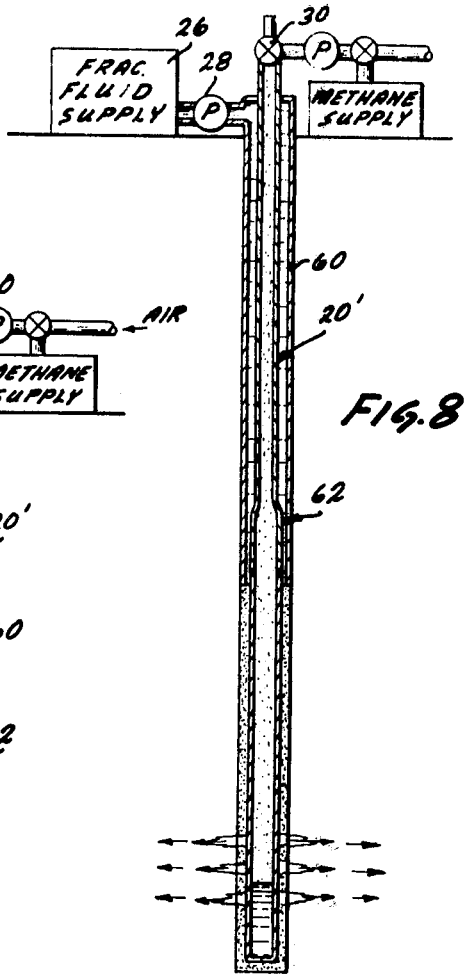
FIG. 8 is a view similar to FIG. 7, but showing the apparatus after gas ignition and during the injection of fracturing fluid into the pay zone formation.

FIGS. 6 through 8 illustrate a well stimulation process for enabling a more rapid recycling by allowing for the pumping of fracturing fluid into the high pressure pipe at a location deep within the well bore. The apparatus utilizes the annular area between a casing 60 and the high pressure pipe 20' that it extends about. The upper portion of the high pressure pipe 20' is of reduced diameter to provide a larger annular cross-section between it and the casing. In addition, a valve 62 is provided near the bottom of the casing to permit the flow of fracturing fluid from the casing into the high pressure pipe.

The fracturing fluid supply 26 in the apparatus of FIG. 6 is connected by the pump 28 to the annular region between the casing 60 and high pressure tube 20' so that fracturing fluid can flow down this region to the valve 62. When the valve 62 is open, as shown in FIG. 6, the fracturing fluid can flow into the high pressure pipe to fill the lower end thereof. After sufficient fracturing fluid has been pumped into the high pressure pipe, the valve 62 is closed. Detonatable gases are then pumped at a predetermined pressure through the control valve 30, as shown in FIG. 7, and the gases are detonated to cause the injection of the fracturing fluid into the pay formation, as shown in FIG. 8. The gaseous products are then exhausted from the high pressure pipe and the process can then be repeated. The time required to pump fracturing fluid into the high pressure pipe is reduced by the fact that the fluid is already located deep within the well in the annular area between the casing 60 and high pressure pipe 20'. The time saving can be significant particularly in the case of deep wells and/or where a very viscous fluid is used.

Figure 9:
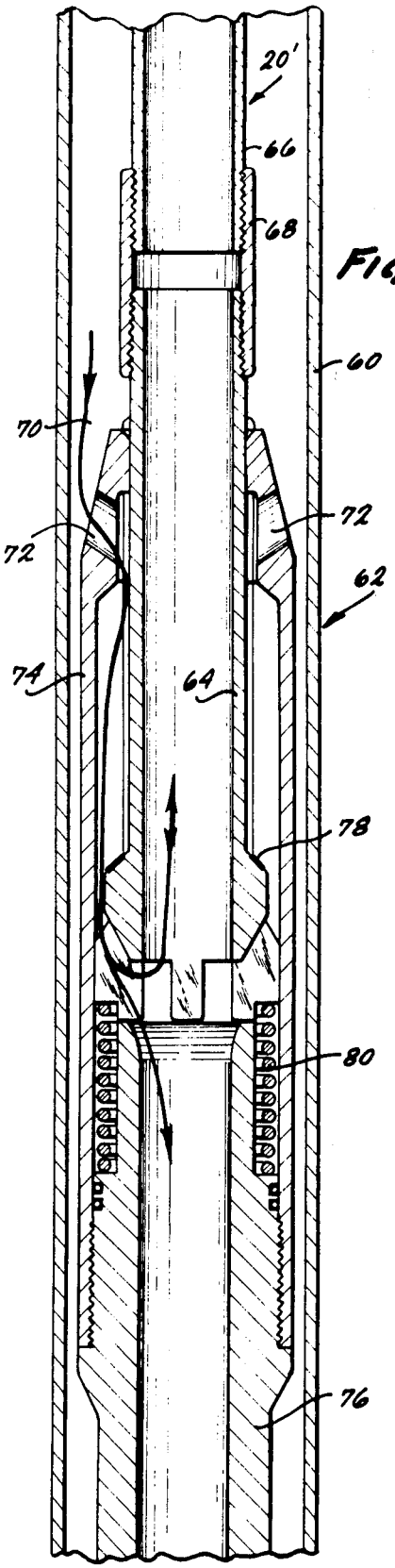
FIG. 9 is a sectional slide view of the mud valve of the apparatus of FIG. 6, in an open configuration.
Figure 10:
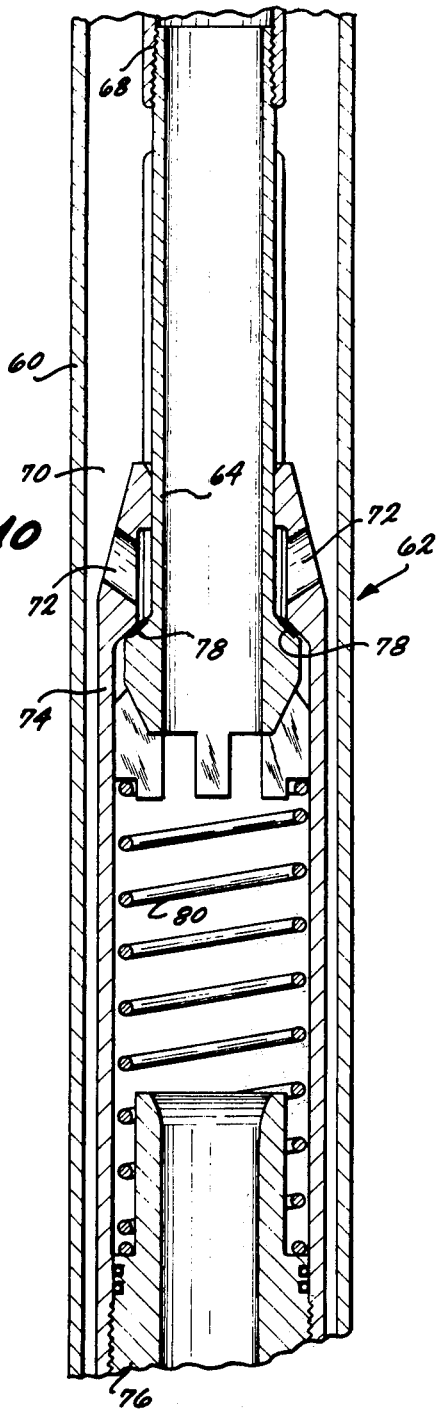
FIG. 10 is a sectional view of the valve of FIG. 9 in a closed configuration.

FIGS. 9 and 10 illustrate details of the valve 62 which controls the flow of fracturing fluid into a lower region of the high pressure pipe 20'. The valve includes a closing member 64 whose upper end is fastened to an upper half 66 of the high pressure pipe by a coupling member 68. When the closing member 64 is in its lower position, as shown in FIG. 9, fracturing fluid can flow through the annular region 70 between the casing the high pressure pipe, through holes 72 in a fitting 74 attached to the lower portion 76 of the high pressure pipe, around the closing member 64 and into the high pressure pipe. However, when the upper half of the high pressure pipe is raised, a seating region 78 of the closing member 64 seats on the fitting 74 to prevent any further inflow of fracturing fluid. A spring 80 helps to raise the closing member to close the valve, although it is also necessary to raise the upper half of the high pressure pipe. It may be noted that after the ignitable gases have been burned and there is a very high pressure in the high pressure pipe 20', this high pressure merely tends to raise the upper half of the high pressure pipe and keep the valve 62 closed.

The invention described thus far herein provides a method and means for the application of fluid to a stratum of the earth with a proper shock wave, duration, pressure flow rate so as to create numerous fractures that result in superior well stimulation. The method includes the establishment of a long column of fracturing liquid above the injection level, with a liquid-free region above it, and the detonation of an explosive gas mixture above the column of fracturing fluid as contrasted to a deflagration of a propellant mixture or the use of a slow burning explosive within the fluid. In many cases, it is desirable to utilize substantially the entire length of the well to hold a long column of fracturing fluid and a large region where gas is detonated.

Figure 11:
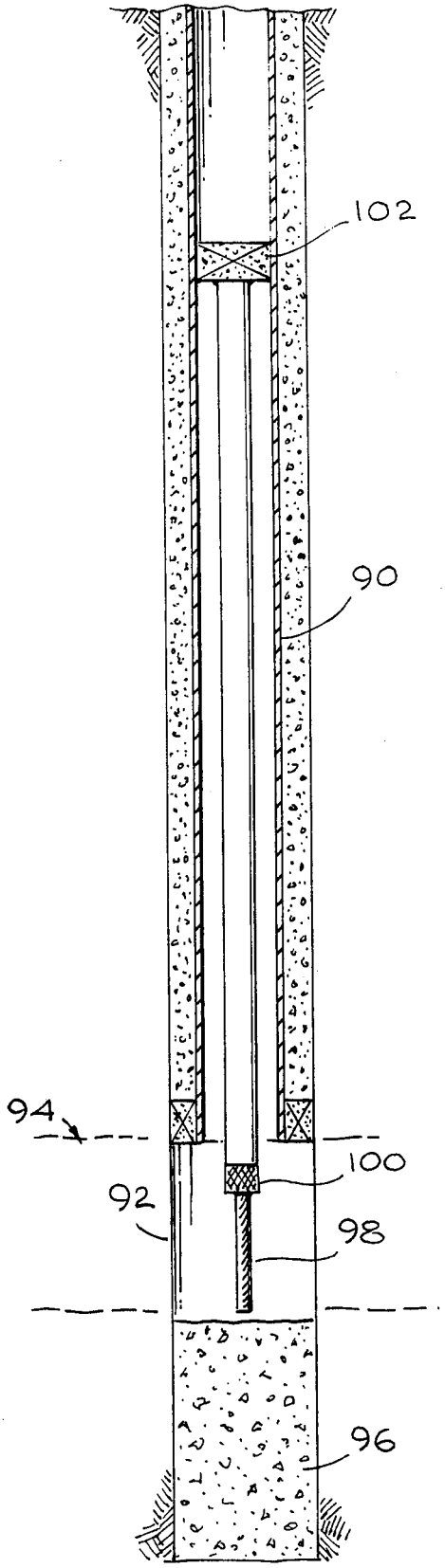
FIG. 11 is a sectional view of a well illustrating another embodiment of the invention.

FIG. 11 is a cross sectional view of a well including an illustration of a method and means for stimulating said well in accordance with another embodiment of this invention. There is a casing 90 around the well bore, which extends down to the pay zone 92, where it and the cement liner is either penetrated to expose the rock 94, in well known manner, as shown previously, or not present as shown, or removed. To confine a stress wave to be created to the rock in the region of the pay zone, the region below the pay zone may be sealed in any suitable manner, such as by a cement plug 96.

A fracturing fluid is then introduced into the well to fill it to some suitable level above the pay zone 92. A suitable amount and type of an explosive, 98, here shown in cylindrical form, plus a firing mechanism 100, is then suspended in the fracturing fluid adjacent the pay zone. A tamp 102, in then used to seal the well at the level to which it has been filled with fracturing fluid, thus providing a gas tight chamber which includes the pay zone and the fracturing fluid above it. The explosive may then be detonated, in manner well known in the art.

The quantity and type of explosive that is selected is such that when detonated it will generate a shock wave in the fracturing fluid which when applied thereby to the exposed rock in the pay zone causes a stress wave therein having an amplitude which will fracture, but not crush the rock, and which has a rise time faster than the time required for sound to traverse one half of the periphery of the rock at the pay zone. A suitable explosive, for example is nitromethane. The amount of the explosive required can be determined by those skilled in the art. By way of illustration, but not as a limitation, it has been determined in some tests that a cylinder of explosive, such as nitromethane which has substantially the length of the exposed pay zone, and a diameter approximately 1/7 of the diameter of the well bore at the pay zone provides the proper quantity and type of explosive. This cylinder is suspended at the center of the well bore at the pay zone. It has been further found that a plastic cylindrical container for the explosive, which has the pressure therein equalized to the surrounding fluid pressure provides the best results. Pressure equalization may be accomplished by having one end of the container in the form of a piston or plug, which is sealingly slidable within the cylinder walls, whereby the surrounding fluid pressure can move this plug into contact with the contents of the cylinder and thus equalize the internal cylinder pressure with that of the surrounding fluid.

Although particular embodiments of the invention have been described and illustrated herein, it is recognized that modifications and variations may readily occur to those skilled in the art and consequently it is intended that the claims be interpreted to cover such modifications and equivalents.

The embodiments of the invention in which an exclusive property or privilege is claimed are defined as follows:

1. A method of fracturing the rock formation at a pay zone at a predetermined depth in a well, comprising:
   establishing an elongated closed chamber in said well of material which can withstand a detonation which can fracture rock and which has openings at said predetermined depth to permit fluid outflow to said rock formation,
   filling said chamber with a fracturing fluid to a level above said predetermined depth,
   applying a shock wave to said fracturing fluid, which has a rise time faster than the time required for sound to traverse one half of the periphery of the well opening in said rock at said pay zone, and which when applied to said rock by said fluid has an amplitude which will fracture said rock but which is less than the amplitude required to crush said rock, whereby said rock formation at said predetermined depth is fractured and fluid is forced into the fractures.

2. A method of fracturing the rock formation at a pay zone as recited in claim 1 wherein the level above said predetermined depth to which said chamber is filled is the top of said chamber,
   wherein the step of applying said shock wave to said fracturing fluid includes,
   suspending a quantity of an explosive within said fracturing fluid at said predetermined depth which, when detonated, creates a stress wave having a rise time which is less than the time required for sound to traverse one-half of the periphery of the well opening in said rock at said pay zone, and which has an amplitude which when applied to said rock by said fluid will fracture said rock but which is less than the amplitude required to crush said rock, and
   detonating said explosive.

3. A method of fracturing the rock formation at a pay zone as recited in claim 1 wherein said level of said fracturing fluid is below the top of said chamber, and
   wherein said step of applying a shock wave to said fracturing fluid includes
   filling the portion of said chamber above the level of said fracturing fluid with a detonable gas at a predetermined pressure which, when detonated creates a shock wave in said fluid having a rise time which is less than the time required for sound to traverse one half of the periphery of the well opening in said rock at said pay zone, and which has an amplitude which when applied to said rock by said fluid will fracture said rock but which is less than the amplitude required to crush said rock, and detonating said gas.

4. Apparatus for stimulating a well that has a casing which can withstand a rock fracturing detonation, and which has a pay zone with rock formation exposed through the casing to permit fluid access to said rock formation, comprising:

a source of a fracturing fluid, means to transfer said fracturing fluid from said source into said well to a level above said pay zone, means for rendering the portion of said well including said fracturing fluid gas tight, and means for applying a shock wave to said fracturing fluid, which has a rise time faster than the time required for sound to traverse one half of the periphery of the well opening in said rock at said pay zone, and which when applied to said rock by said fluid has an amplitude which will fracture said rock but which is less than the amplitude required to crush said rock, whereby said rock formation at said predetermined depth is fractured and fluid is forced into the fractures.

5. Apparatus as recited in claim 4 wherein said means to transfer said fracturing fluid transfers enough fluid to completely fill said gas tight portion of said well, said means for applying a shock wave to said fracturing fluid includes detonable explosive means for generating, when detonated, in said fracturing fluid, a shock wave which has a rise time greater than the time required for sound to traverse one half of the periphery of said rock around the opening in said well at said pay zone, and which when applied to said rock by said fluid has an amplitude which can fracture but not crush said rock, means for suspending said detonable explosive means within said fracturing fluid at said pay zone, and means for detonating said detonable explosive means.

6. Apparatus as recited in claim 4 wherein said means to transfer said fracturing fluid transfers enough fluid to fill said well above said pay zone leaving a space between the top of said fluid and the top of said gas tight portion of said well, said means for applying said shock wave to said fracturing fluid includes, a source of a detonable gas which under a predetermined pressure, when detonated creates a shock wave which has a rise time greater than the time required for sound to traverse one half of the periphery of said rock around the opening in said well at said pay zone, and which when applied to said rock by said fluid has an amplitude which can fracture but not crush said rock, means for filling said space from said source of detonable gas, with said detonable gas to said predetermined pressure, and means for detonating said detonable gas.

7. Apparatus for stimulating a well that has a pay zone at a predetermined depth that has exposed rock comprising:

means for applying a stress wave to the rock at said pay zone with an amplitude sufficient to cause fractures in said rock without crushing same, and having a rise time faster than the time required for sound to traverse one half of the perimeter of said rock at said pay zone, including a source of a fracturing fluid, means for transferring fracturing fluid from said source into said well to fill said well to a level above said pay zone, means for sealing the portion of said well including said fluid and pay zone, and means for applying a detonation to said fracturing fluid which produces a stress wave therein which when applied thereby to said rock at said pay zone will provide said indicated stress wave.

8. A method of fracturing the rock formation at a predetermined depth in a well, comprising:

establishing an elongated chamber in said well of material which can withstand a detonation which can fracture rock, and which has an upper portion which is gas tight and a lower portion extending beyond said predetermined depth and having openings at said predetermined depth to permit fluid outflow to said rock formation;

filling said lower portion of said chamber with fracturing fluid above the level of said predetermined depth until said upper portion has been reached;

filling the upper portion of said chamber with a predetermined pressure of a gas, which when detonated creates a shock wave in said fracturing fluid having a rise time which is less than the time required for sound to traverse one half of the periphery of the well opening in said rock, at said pay zone and which has an amplitude which will fracture said rock but which is less than the amplitude required to crush that rock, and;

detonating said detonatable gas to produce said shock wave which fractures said rock formation at said predetermined depth and forces said fracturing fluid through said open region of said lower chamber portion into the fractures in said rock formation.

9. The method described in claim 8 wherein said upper portion of said elongated chamber and said lower portion of said elongated chamber are on the same order of magnitude in length.

10. The method described in claim 8 including:

venting said upper portion of said chamber to allow the escape of most of said pressured gas products;

flowing additional fracturing liquid into said chamber to fill substantially said lower chamber portion;

pumping additional detonatable gas into said chamber to fill said upper portion of said chamber with said gas at a predetermined pressure; and igniting said additional detonatable gas in said upper chamber portion to force at least some of said additional fracturing liquid down and out through said open region of said lower chamber portion, whereby to elongate fractures previously created in the formation.

11. The method described in claim 8 wherein:

said step of establishing an elongated chamber includes lowering a pipe down said well and permanently anchoring only a lower region of said pipe in said well; and including uncoupling a region of said pipe above said lower region and lifting it out of said well, whereby to enable maximum reuse of equipment, particularly in the case of deep wells.

12. A well stimulation method for use in a hydrocarbon well that extends into a pay zone that lies at least several hundred feet below the surface of the earth, and wherein the well has a casing which can withstand a detonation which can fracture rock, said casing having openings for the outflow of fluid to the rock formation at said pay zone, comprising:

pumping a fracturing fluid down into said well to a level substantially above said pay zone to fill at least a lower portion of said well with a column of said fluid;

covering the top of said well to render the upper portion of said well above said fluid level gas tight;

filling said upper portion of said well with a detonatable gas at a pressure which when detonated generates a shock wave in said fracturing fluid having a rise time which is less than the time required for sound to traverse one half of the periphery of the rock around the opening in said well at said pay zone, which has an amplitude which can fracture rock but is less than the amplitude required to crush said rock, and detonating said gas to cause the creation of multiple fractures in said rock at said pay zone and to create a high pressure reservoir of gaseous combustion products that pump at least some of said fracturing fluid through said well casing into the rock fractures around said pay zone.

13. The method described in claim 12 including:

establishing an elongated chamber in said well, an annular outer passageway of at least several hundred feet in length surrounding an upper region of said elongated chamber, and valve means coupling the lower end portion of said annular passageway to said chamber; and wherein said step of pumping fracturing fluid includes pumping it down through said annular passageway and through said valve means into said chamber, whereby to enable more rapid recycling of the fracturing process, particularly in the case of deep wells.

14. Apparatus for stimulating a well that has a casing which can withstand a rock fracturing detonation and which has openings therein to permit fluid access to the rock formation at a pay zone comprising:

a source of fracturing fluid;

means to fill said well with said fracturing fluid from said source, to a level above said pay zone but leaving unfilled a substantial region of said well above the level of said fluid;

means for rendering the portion of said well above the level of said fracturing fluid gas tight, a source of a detonable gas, which, under a predetermined pressure, when detonated produces a shock wave in said fracturing fluid having an amplitude which has a rise time faster than the time required for sound to traverse one half of the perimeter of the rock at said pay zone, an amplitude which is sufficient to fracture rock but is less than is required to crush rock;

means for filling said substantial region of said well with said gas under said predetermined pressure; and means for detonating said gas whereby a multiplicity of radial fractures are established in said rock formation at said pay zone.

15. Apparatus for stimulating a well that has a pay zone at a predetermined depth comprising:

means for applying a stress wave to the rock at said pay zone with an amplitude sufficient to cause fractures in said rock without crushing same, and having a rise time sufficiently rapid to avoid stress and pressure relief by any of said fractures, including pipe means for establishing an enclosed chamber within said well which extends from the top of said well below said predetermined depth, which has openings to said pay zone, and which can withstand a detonation which will fracture rock;

a source of a fracturing fluid;

means for filling said chamber in said pipe means with said fracturing fluid to a level above said pay zone but leaving a substantial unfilled region of said well above the level of said fluid, a source of a detonatable gas which when a predetermined quantity under a predetermined pressure is detonated produces a shock wave in said fracturing fluid which has a rise time faster than the time required for sound to traverse through one half of the perimeter of the rock formation at the pay zone, which has an amplitude which can fracture rock but is less than that required to crush rock;

means for filling the substantial unfilled region of said well with said predetermined quantity at said predetermined pressure of said gas from said source, and means for detonating said gas.

16. Apparatus as recited in claim 15 where said substantial unfilled region of said well is at least 100 feet long.

17. Apparatus as recited in claim 15 wherein said pipe means includes a first pipe for containing said detonatable gas extending from the top of said well down below the surface of the fluid in said well, but not to the level of said pay zone, said first pipe having a diameter which is less than the diameter of said well, a second pipe extending from the lower end of said first pipe below said pay zone, coupling means for connecting said first pipe to said second pipe when it is desired to fill said first pipe with said detonatable gas and to detonate said gas, and means for disconnecting said first pipe from said second pipe to enable fracturing fluid to be added to said second pipe through the space around said first pipe.

* * * * *